United States Patent [19]

Tømt et al.

[11] 4,157,230

[45] Jun. 5, 1979

[54] JOINT FOR PILE SECTIONS

[75] Inventors: Arne Tømt, Kambo; Ivar Vamnes, Nesoddhøgda, both of Norway

[73] Assignee: B. Brynildsen & Sonner A/A, Moss, Norway

[21] Appl. No.: 907,322

[22] Filed: May 18, 1978

[30] Foreign Application Priority Data

Jun. 7, 1977 [NO] Norway ..... 771988

[51] Int. Cl.[2] ..... E02D 5/30; E02D 5/32

[52] U.S. Cl. ..... 405/252; 52/726; 403/296

[58] Field of Search ..... 151/41, 39, 35, 37; 403/296, 320, 343; 61/56; 405/252, 251; 52/726

[56] References Cited

U.S. PATENT DOCUMENTS

| | | | |
|---|---|---|---|
| 907,473 | 12/1908 | Detray | 151/39 |
| 1,303,715 | 5/1919 | Outlaw | 151/39 X |
| 2,159,160 | 5/1939 | Horsch et al. | 151/41 |
| 3,016,248 | 1/1962 | Lindberg | 151/41 X |

FOREIGN PATENT DOCUMENTS

| | | | |
|---|---|---|---|
| 101614 | 5/1963 | Norway | 403/296 |

*Primary Examiner*—Andrew V. Kundrat

*Attorney, Agent, or Firm*—Cushman, Darby & Cushman

[57] ABSTRACT

An improved joint for pile sections which have a nut at the ends, fastened such that one of its end surfaces is in the same plane as the end surface of the pile section. The joint being effected by a threaded bolt which engages with the nuts on two cooperating pile sections. The nut is provided with an annular groove having radially-directed locking notches in the bottom. A locking disk is inserted into the groove. The disk has resilient locking tongues with radial edges which are directed against the unscrewing direction and which engage with the notches in the nut.

4 Claims, 4 Drawing Figures

JOINT FOR PILE SECTIONS

The present invention relates to an improved joint for pile sections, especially concrete pile sections, of the type in which the ends of the pile section are provided with a nut fastened such that one of its end surfaces lies in the same plane as the end surface of the pile section, the joining of two such pile sections then being effected by a threaded bolt which engages with the respective nuts on the two sections. Pile joints of this type are known from Norwegian Pat. No. 101.614, and piles having joints of this type are now widely used.

A pile is subjected to longitudinal pressure waves when it is being driven. These pressure waves are propagated down through the pile at a speed corresponding to the speed of sound in the pile material in question. When the pressure waves reach the tip of the pile, they will be reflected upwards through the pile again. If resistance at the tip is zero, the pressure wave will be reflected as tensile waves having the same amplitude as the pressure wave. At infinite tip resistance, a pressure wave will be reflected, but in this case, too, tension waves will occur in the pile, because the reflected pressure wave will be reflected again from the top of the pile as a tensile wave. In other words, a large number of tensile impulses will always occur when a pile is being driven.

The magnitude of the tolerable tensile force will be limited by the tensile strength of the pile. In a concrete pile, this will be the tensile strength of the reinforcement, because if this limit were exceeded during driving, the concrete would crack perpendicular to the axis of the pile.

In a joint of the above type, the tensile impulses will make the joint have a tendency to unscrew. The magnitude of this unscrewing moment has an upper limit which is equal to the tensile strength of the pile multiplied by the helix angle of the thread in radians. For piles of the above type, of the size most commonly in use today, this moment will be in the range of 400–700 kNm, discounting the effects of friction in the joint, both between the concrete end surface and in the threads. This unscrewing of the joint will normally not present a problem because the tensile impulses are of very brief duration (millisecond order of magnitude). As the pile has a certain rotational inertia, a very great number of blows would be required to produce a registrable unscrewing movement, and as soon as the joint has been driven into the ground, the friction of the ground against the lateral surfaces of the pile will prevent unscrewing. However, situations can be imagined in which the number of blows required to drive the pile to a depth at which the joint is fixedly held by the ground's friction would be sufficiently great to effect a harmful unscrewing. This could occur, for example, when driving a pile into very solid moraine under water or when chiseling into rock.

The purpose of the present invention is to improve the pile joint such that undesirable screwing movement is prevented. The locking mechanism required must have a sufficiently high moment of fracture, but the moment of fracture must not be so great that the piles cannot be screwed apart if this is necessary or desirable. The locking mechanism must be made such that it will not be released or damaged by the passage of tensile waves through the joint. Owing to these requirements, fixed connections such as welds or shot-bolts in the lateral surfaces of the pile cannot be used. In addition, the locking mechanism should be inexpensive to produce and simple and quick to use.

These conditions are met, in accordance with the invention, by an improved joint means for pile sections having a nut at the ends which is fastened such that one end surface thereof lies in the same plane as the end surface of the pile section, the joint being effected by a threaded bolt which engages with the nuts on two cooperating sections. The improvement is characterized in that the nuts in each pile joint are provided with a counterbore having radially-directed locking notches in the bottom of the counterbore and in that a known per se locking disk is inserted into said groove, the disk having resilient tongues with radial edges which engage with the notches in the nut.

Another characteriztic feature of the invention is that the depth of the counterbore in the nut is adapted relative to the thickness of the disk as measured at the edge of the tongues, such that the pressure of the tongues on the disk against the bottom of the counterbore is approximately constant and thus insignificantly dependent on tensile impulses in the joint.

In order to permit the joint to be unscrewed if desired, in a preferred embodiment of the invention the ridges between the notches in the bottom of the counterbore are dimensioned such that the ridges will be cut off by the tongues on the locking disk when sufficient unscrewing force is applied. Theoretically, the upper limit for the permissible unscrewing moment should be equal to the torsion capacity of the pile, but for practical reasons the limit must be set significantly lower, such that the strength of the locking mechanism, i.e., the strength of the ridges, preferably does not exceed the necessary strength by more than the amount required to provide a sufficient margin of safety for preventing undesired unscrewing of the joint. The necessary safety factor is estimated to be in the range of from 1.5 to 2.0.

The invention will be further elucidated with reference to the drawings, which show one embodiment of the invention.

Figure 1:
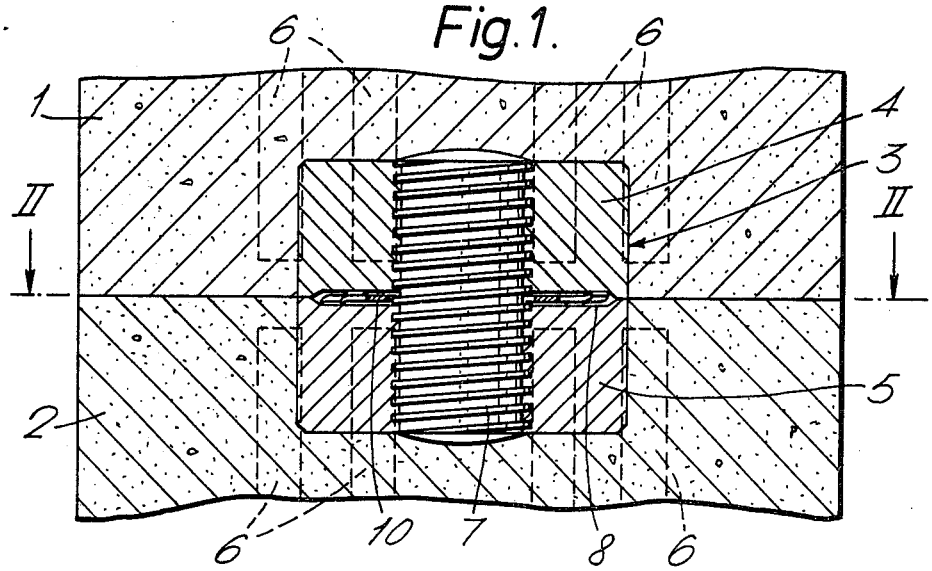
FIG. 1 is a cross section through two abutting pile sections having the improved joint according to the invention.
Figure 2:
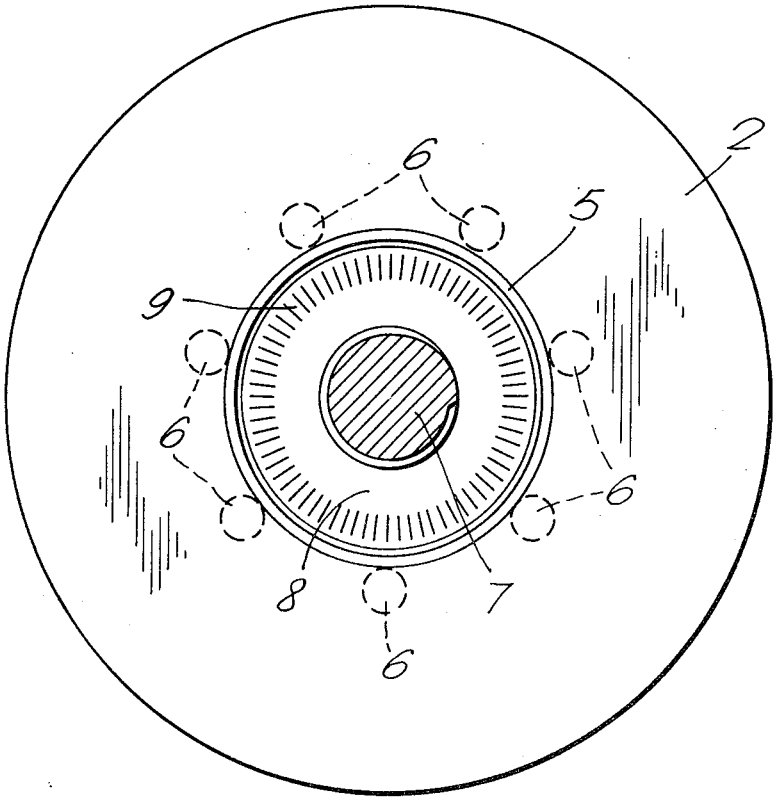
FIG. 2 is a cross section along line II—II of FIG. 1.
Figure 3:
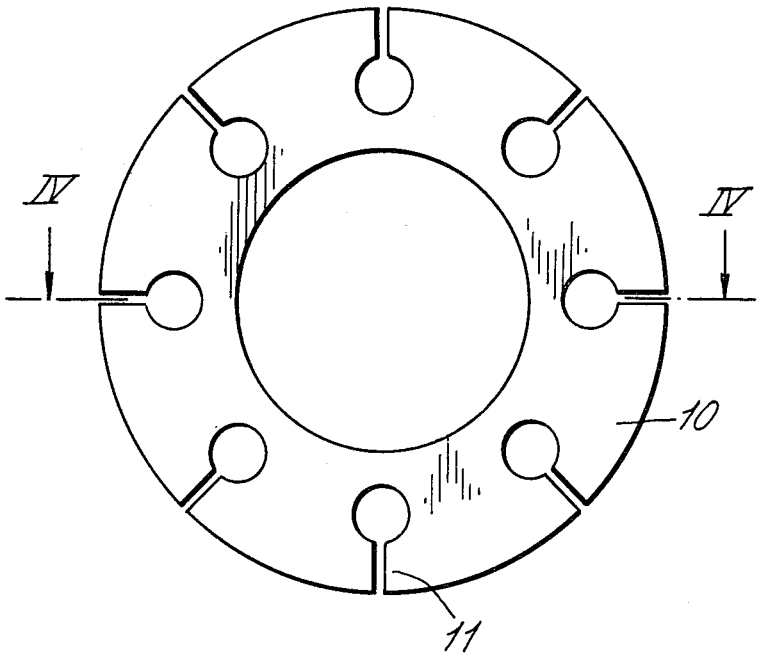
FIG. 3 is a plan view of a locking disk for the joint of the invention.

FIG. 1 illustrates the joining of two concrete pile sections 1 and 2 by means of a pile joint generally designated as 3. The pile joint 3 consists of nuts 4 and 5 which are mounted in the ends of the adjacent pile sections 1 and 2, the outer ends of the nuts being flush with the outer ends of the pile sections, as seen on FIG. 1. The end surfaces of the abutting pile sections 1 and 2 are extremely plane in order to obtain as strong a connection between the sections as possible. The nuts 4 and 5 have been welded to the longitudinal reinforcing rods 6 in the pile sections. In the threaded central bore in the nuts, a threaded bolt 7 is screwed. As can be seen on FIGS. 1 and 2, a counterbore 8 has been machined into the nuts, notches 9 having been cut into the bottom of the counterbore. In the annular space formed between two adjoining nuts 4 and 5 by the counterbore 8, a ring-shaped locking disk 10 is inserted, as seen in more detail on FIGS. 3 and 4.

Figure 4:
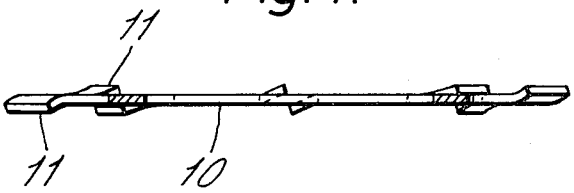
FIG. 4 is a cross section through the locking disk along line IV—IV of FIG. 3.

The locking ring 10 is a stamped spring steel disk with axially-directed locking tongues 11. The tongues 11, as can be seen on FIG. 4, are bent out on both sides of the plane of the disk 10 and, owing to quality of the material, are resilient.

When the ring 10 is inserted in the adjacent counterbore 8 and the joint screwed together, the pawl-like tongues will jump over the ridges between the notches in the bottom of the counterbore, because the tongues are directed away from the screwing direction. Conversely, if tensile impulses during the pile driving attempt to unscrew the piles, the joint cannot be unscrewed because the tongues are directed against the unscrewing direction and will remain inside the notches in contact against the ridges between the notches.

If one wishes to screw the joint apart, the application of sufficient force against the tongues will cause the tongues to cut off the ridges between the notches.

Having described our invention, we claim:

1. An improved joint for pile sections, which have a nut at the ends, fastened such that one of its end surfaces is in the same plane as the end surface of the pile section, the joint being effected by a threaded bolt which engages with the nuts on two cooperating pile sections, characterized in that the nut is provided with a counterbore having radially-directed locking notches in the bottom, and in that a locking disk is seated in the counterbore, said disk having resilient locking tongues with radial edges which are directed against the unscrewing direction and which engage with the notches in the nut.

2. The improved pile joint according to claim 1, characterized in that the depth of the counterbore in the nuts is adapted relative to the thickness of the locking disk as measured at the edge of the tongues, such that the pressure of the tongues on the disk against the bottom of the counterbore will be approximately constant and only insignificantly dependent on tensile impulses in the joint.

3. The improved pile joint according to claim 2, characterized in that the ridges between the notches in the bottom of the counterbore are dimensioned such that if one wishes to unscrew the joint, the ridges will be cut off by the tongues on the locking disk upon the application of a force in the range of from 1.5 to 2.0 times the theoretical unscrewing force on the pile during driving, and sufficiently far below the torsional capacity of the pile.

4. The improved joint of claim 1 wherein each of the pile sections is formed of concrete and of longitudinally extending internal metal reinforcing members which are secured to the respective nut.

* * * * *